US009752792B2

(12) United States Patent
Darum

(10) Patent No.: US 9,752,792 B2
(45) Date of Patent: Sep. 5, 2017

(54) BUILDING VENTILATION SYSTEM CONNECTION DETECTION

(71) Applicant: VKR HOLDING A/S, Horsholm (DK)

(72) Inventor: Jesper Darum, Brondby (DK)

(73) Assignee: WindowMaster A/S, Vedbaek (DK)

( * ) Notice: Subject to any disclaimer, the term of this patent is extended or adjusted under 35 U.S.C. 154(b) by 470 days.

(21) Appl. No.: 14/220,498

(22) Filed: Mar. 20, 2014

(65) Prior Publication Data

US 2014/0287673 A1 Sep. 25, 2014

(30) Foreign Application Priority Data

Mar. 22, 2013 (EP) ..... 13160703

(51) Int. Cl.

| | |
|---|---|
| ***G08B 23/00*** | (2006.01) |
| ***F24F 11/02*** | (2006.01) |
| ***F24F 11/00*** | (2006.01) |
| *F24F 7/00* | (2006.01) |

(52) U.S. Cl.

CPC ..... *F24F 11/02* (2013.01); *F24F 11/0001* (2013.01); *F24F 11/0086* (2013.01); *F24F 2007/003* (2013.01); *F24F 2011/0046* (2013.01); *F24F 2011/0052* (2013.01); *F24F 2011/0056* (2013.01); *F24F 2011/0095* (2013.01)

(58) Field of Classification Search

CPC ..... F24F 11/02
USPC ..... 454/254, 256
See application file for complete search history.

(56) References Cited

U.S. PATENT DOCUMENTS

| | | | | |
|---|---|---|---|---|
| 5,449,987 | A | 9/1995 | McMillan | |
| 5,451,929 | A | 9/1995 | Adelman et al. | |
| 7,241,218 | B2 * | 7/2007 | Van Becelaere | F24F 11/0001 454/369 |
| 7,891,139 | B2 * | 2/2011 | Nagakura | E05F 17/00 49/24 |
| 2004/0224627 | A1 | 11/2004 | Becelaere et al. | |
| 2005/0156731 | A1 | 7/2005 | Chapman et al. | |

(Continued)

FOREIGN PATENT DOCUMENTS

| | | | |
|---|---|---|---|
| DE | 19937530 | A1 | 2/2001 |
| WO | 03074946 | A1 | 9/2003 |

OTHER PUBLICATIONS

European Patent Application No. EP 13160703.8, Extended European Search Report mailed Aug. 6, 2013, 4 pages.

*Primary Examiner* — Helena Kosanovic
(74) *Attorney, Agent, or Firm* — Dean W. Russell; Kilpatrick Townsend & Stockton LLP

(57) ABSTRACT

A building ventilation system (1) comprising a central unit (2) and at least one electrical operating unit (3) for adjusting a movable member of a ventilation device, the central control unit (2) is connected to the at least one electrical operating unit (3) by two power supply wires (4) and configured to provide an operating voltage for operation of the at least one electrical operating unit (3) via the two power supply wires (4), wherein the power supply lines (4) are connected to an end module (5) and the central control unit (2) further is configured to provide a test voltage being lower than the operating voltage, wherein the end module (5) is configured to temporarily vary its load impedance with a predetermined pattern, and the central control unit (2) is configured to detect the temporarily varying load impedance of the end module.

12 Claims, 3 Drawing Sheets

(56) References Cited

U.S. PATENT DOCUMENTS

Figure 1:
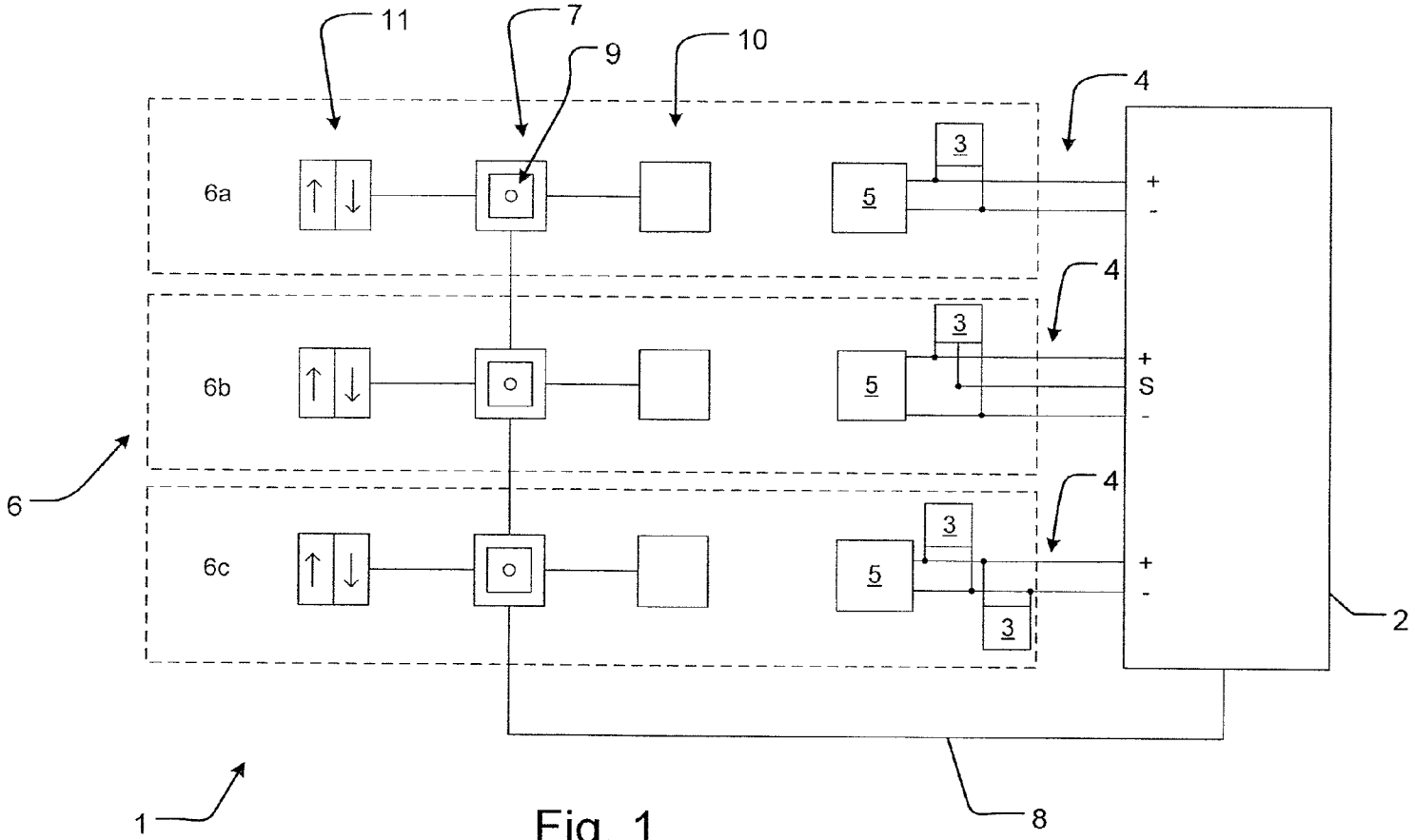

| | | | | |
|---|---|---|---|---|
| 2008/0179052 | A1 | 7/2008 | Kates | |
| 2010/0066557 | A1 * | 3/2010 | Henson | H02H 9/001 340/693.1 |

* cited by examiner

BUILDING VENTILATION SYSTEM CONNECTION DETECTION

CROSS-REFERENCE TO RELATED APPLICATIONS

The present application claims priority from European Patent Application No. 13160703.8 filed on Mar. 22, 2013, the entirety of which is hereby incorporated by reference into this application.

The present invention relates to a building ventilation system comprising a central unit and at least one electrical operating unit for adjusting a movable member of a ventilation device.

When such systems are used as a smoke ventilation system it is required that a surveillance of the wired connection between the electrical operator units and the central control unit is provided so that a wire break is detected. It is known to provide a further wire in order to provide such surveillance of the connection between the electrical operator unit and the central control unit. Besides from requiring a further wire such known solutions are only capable to determine if the connection is in working order when the electrical operating units are in operation or in their outer positions. Because of the significant costs as to labour and costly materials it is desirable to reduce the amount of wiring and due to the above-mentioned constraints the existing two wire installations are not suitable for use in a smoke ventilation system without the provision of further wiring.

WO 03/074946 provides a general disclosure of a computer controlled method and system for controlled natural ventilation of ventilation zones in a building by adjustment of passive ventilation devices with movable members, typically in the form of operable window sections in buildings or other types of operable sections such as adjustable dampers grids and similar devices. The movable members are adjusted by electrical operator units connected to a central control unit by means of three wires, viz. two power supply wires and a communication wire.

Therefore it is the object of the present invention to provide a building ventilation system that allows for a more simple and efficient surveillance of the wired connection between the electrical operator units and the central control unit.

According to a first aspect the invention relates to a building ventilation system comprising a central unit and at least one electrical operating unit for adjusting a movable member of a ventilation device, the central control unit is connected to the at least one electrical operating unit by two power supply wires and configured to provide an operating voltage for operation of the at least one electrical operating unit via the two power supply wires, wherein the power supply lines are connected to an end module and the central control unit further is configured to provide a test voltage being lower than the operating voltage, wherein the end module is configured to temporarily vary its load impedance with a predetermined pattern, and the central control unit is configured to detect the temporarily varying load impedance of the end module. Such configuration of a building ventilation system takes advantage of the fact that electrical operating units for adjusting a movable member of a ventilation device have a high impedance at voltages below the operating voltage. Thereby it is possible to provide the end module with a test voltage without activating the electrical operating unit, because the test voltage is below the operating voltage required by the electrical operating unit and thereby insufficient for operation of the electrical control unit. When the end module is provided with the test voltage it may be activated, and start to temporarily vary its load impedance with the predetermined pattern (typically resulting in a temporarily varying total impedance of the building ventilation system). This specific predetermined load impedance pattern may be detected by the central control unit. The detection of the temporarily varying load impedance of the end module by the central control unit indicates that the two power supply lines are intact and in working order for providing the required operating voltage to the electrical operating unit, because the electrical operating unit is positioned between the central control unit and the end module. Thereby it is possible to provide the surveillance required in a smoke ventilation system even with the presence of only two power supply wires.

Moreover, it is possible to detect a wire break without actually operating the electrical operating unit and the connection provided by the power supply lines may be tested independently of the actual operating position of the electrical operating unit. This also makes periodically testing of the power supply lines possible, which reduces the power consumption in connection with testing of the connection between the central control unit and the end module. This principle may also be advantageous in three wire systems with a dedicated communication wire, because all the power supply wires may be tested for faults without individually communicating with the electrical operating units powered by the power supply wires.

In an embodiment according to the invention, the end module is configured to temporarily vary its load impedance by being switchable between a low impedance state and a high impedance state, wherein the end module provides an alternative circuit path circumventing the at least one electrical operating unit when the end module is in the low impedance state.

Consequently, a simple way of altering the load impedance of the end module is provided.

In an embodiment according to the invention the impedance of the end module is lower than the impedance of the at least one electrical operating unit, when the end module is in the low impedance state.

The impedance of the end module may be less than 90%, 75%, 50%, or 25% of the impedance of the at least one electrical operating unit, when the end module is in the low impedance state and the test voltage is provided.

The impedance of the end module may be approximately zero, when the end module is in the low impedance state.

This may reduce test power consumption.

In an embodiment according to the invention the impedance of the end module is higher than the impedance of the at least one electrical operating unit, when the end module is in the high impedance state and the test voltage is provided.

The impedance of the end module may be may be at least 2 times, 4 times, or 10 times higher than the impedance of the at least one electrical operating unit, when the end module is in the high impedance state and the test voltage is provided.

The impedance may be approximately infinite when the end module is in the high impedance state and the test voltage is provided.

Consequently, by having a high difference in the impedance of the end module between the two states, it becomes easier for the central control unit to detect the temporal varying load impedance. This may make it easier to detect faults.

In an embodiment according to the invention the end module is in the low impedance state at least 20%, 30%, or 50% of the time when the test voltage is provided This has the advantage of reducing the power consumption used for detection of the connection between the central control unit and the end module.

In a further embodiment of the invention the test voltage insufficient to operate the at least one electrical operating unit is less than 50% of the operating voltage, preferably less than 25% of the operating voltage, and even more preferably about 15% of the operating voltage.

In a further practically preferred embodiment of the invention the temporarily varying load impedance of the end module is detected in the central control unit by measuring a voltage variation. This allows the detection of the connection between the central control unit and the end module to be carried out with a low power consumption and with a very low test voltage.

Moreover, circuitry at the central control unit may be implemented using less costly standard components.

In an embodiment according to the invention, the end module is connected to the central unit by no more than the two power supply wires.

Figure 2:
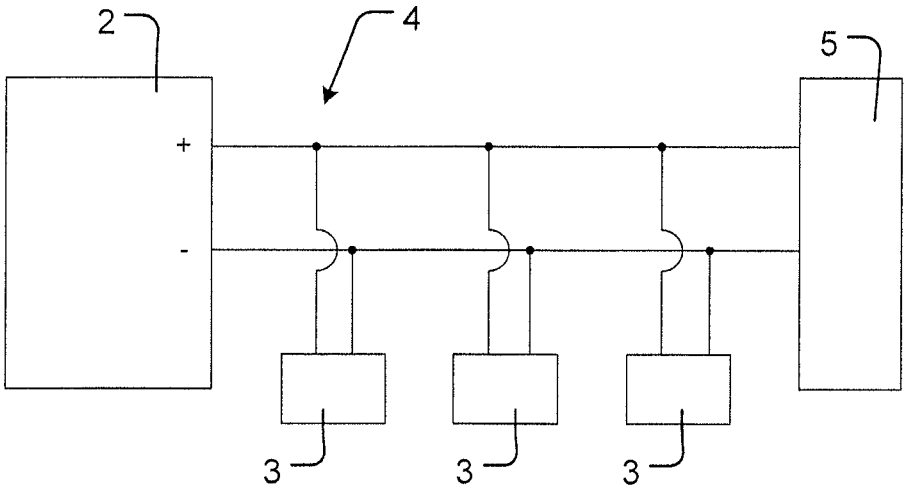
Figure 3:
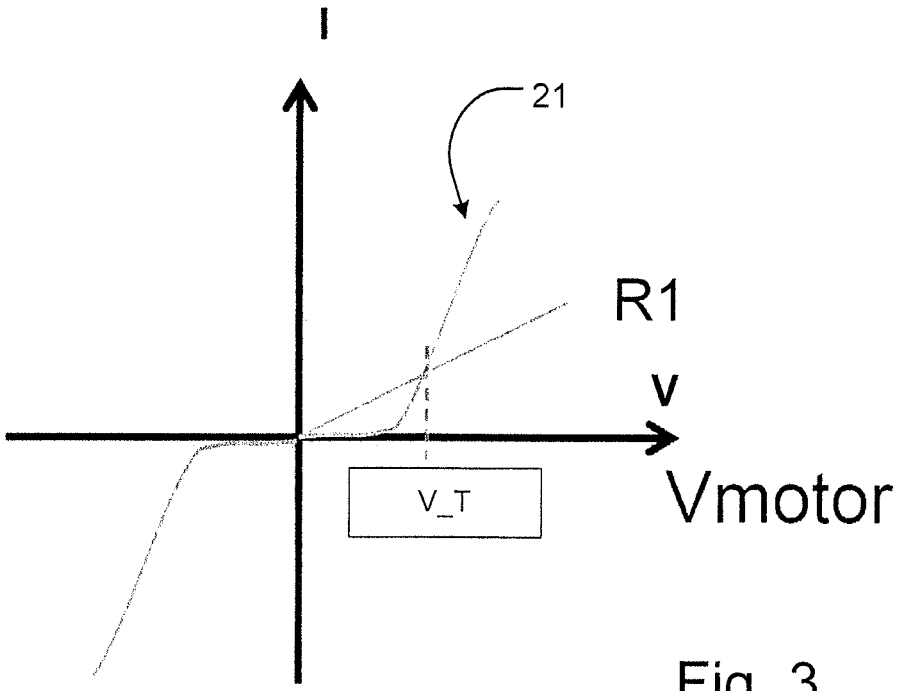
Figure 4:
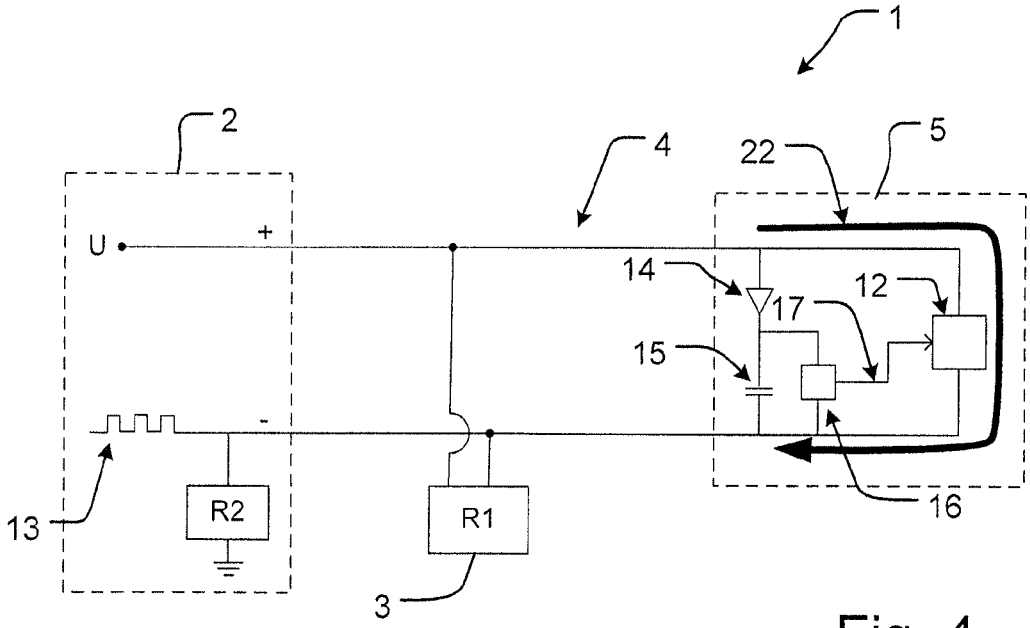

In the following the invention will be described in greater detail based on an exemplary embodiment, and with reference to the schematic drawing, on which FIG. 1 shows a schematic diagram of a building ventilation system according to an embodiment of the invention, FIG. 2 shows a schematic diagram of the wiring between a central control unit, electric operating units, and an end module according to an embodiment of the invention, FIG. 3 shows a part of a voltage/current graph for electrical operating unit according to an embodiment of the invention, FIG. 4 shows a diagram of a central control unit, an electrical operating unit, and an end module according to an exemplary embodiment of the invention.

Figure 5:
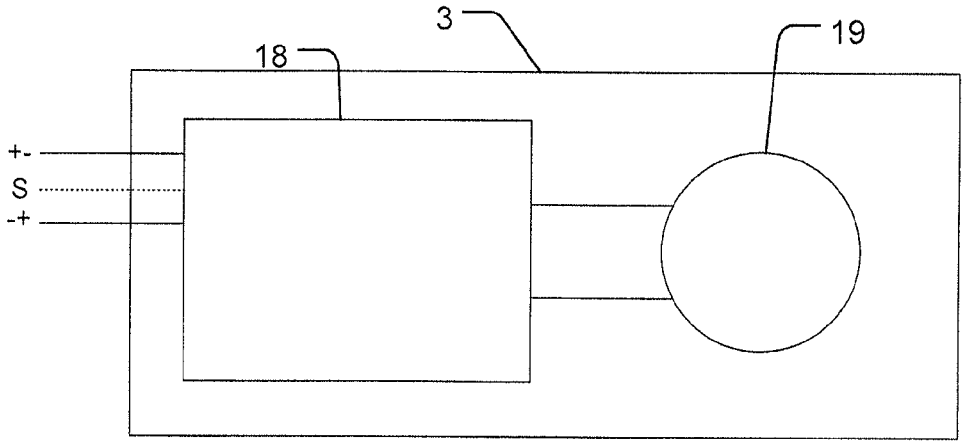

FIG. 5 shows a schematic diagram of an electric operating unit according to an embodiment of the present invention.

FIG. 1 shows a building ventilation system 1 comprising a central control unit 2 connected by power supply wires 4 to electrical operating units 3 of different building areas 6. In the following the building ventilation system 1 according to the invention is described when used as a smoke ventilation system for controlling the extraction of smoke and heat in case of fire, where the electrical operating units 3 are deployed as electrical window actuators for opening and closing a movable member of windows. However, the system according to the invention is also suitable for building climate comfort control using natural ventilation and with other ventilation devices such as ducts, hatches and vents. The electrical operating units 3 are powered by the central control unit 2 by the power supply wires 4 as illustrated in the right hand side of FIG. 1, i.e. with a power supply voltage such as 24 V, which is sufficient to take into account the voltage drop over the power supply lines. The operation of the electrical operating units 3 is controlled by the system controller 2. Each building area 6 may comprise several electrical operating units 3 connected to the same power supply wires as illustrated with the building area denoted 6*c*. A building area may be served by several pairs of power supply wires 4. As illustrated for the building area denoted 6*b*, some of the electrical operating units 3 may further be connected to the central control unit 2 by a communication wire via a port denoted S. In that situation a cable with at least three wires between the central control unit 2 and each electrical operating unit 3 or group of electrical operating units 3 is required, i.e. one wire is used for communication and two wires are used as power supply lines.

In situations illustrated with building areas 6*a* and 6*c* where only two wires between the central control unit 2 and the electrical operating unit 3 or groups of electrical operating units 3 are available, electrical operating units 3 configured for operation based on only the power supply lines may be deployed. Such electrical operating units 3 are controlled to open and close a window by providing an operating voltage via the power supply wires 4 for a predetermined time period allowing the window actuators to open a window. In order to close the window the operating voltage provided via the power supply lines is reversed, which will reverse the operation of the electrical operating unit 3 so that the window may be closed.

The electrical operating units of this type have a high impedance and will thus not operate at voltages below a specified operation voltage, which typically is 18 V. The electrical operating units 3 are typically provided with a control circuit causing the high input impedance at low voltages below 9 V and therefore operation of the electrical operating units 3 at low voltages below the required operating voltage is not possible. The control circuits for controlling operation of the electrical operating unit may inter alia comprise an electronic end stop.

The electrical operating units 3 may be of the type WMU 884-2 0600 from WindowMaster®, which is for use with a control wire as well as without, and furthermore is configured for synchronised operation of electrical operating units 3 grouped in a building area. This is advantageous in case more than one electrical operating unit 3 is required for moving a sash with respect to a frame of a window. The synchronised operation is achieved between the members of a group of electrical operating units 3 enabled for synchronised operation and without involving the central control unit 2, which generally controls the operation of the electrical operating units 3 in order to open and close windows of a building area 6. In case synchronised operation is not required, the electrical operating units 3 may be of the type WMU 884-1 0600 from WindowMaster®, which is also connected to the system controller 2 by two power supply wires 4 and optionally a communication wire. The operation of electrical operating units 3 of the above-mentioned types may be controlled by the system controller 2 via the communication line and position detectors. For instance an end stop detector in the electrical operating unit may be used to return a status signal to the system controller 2.

As shown in FIG. 1 the power supply wires are terminated in an end module 5. The end module 5 is provided with an electric circuitry that temporarily can vary the load impedance of the end module 5 with a predetermined pattern in response to a test voltage provided by the central control unit 2 via the power supply wires 4 to the end module 5. Hence, when the electrical operating units 3 are not operated, the central control unit 2 may for instance periodically supply the test voltage to the end module 5 via the power supply wires 4. The test voltage provided to the electric circuitry of the end module 5 results in a temporal variation of the load impedance of the end module 5 with a predetermined pattern which is detected by the central control unit 2. The characteristic predetermined load impedance pattern may for instance be created by having an end module that is switchable between a low impedance state and a high impedance state. The test voltage may be about 3 V.

The connection between the central control unit 2 and the end module 5 is shown in more detail in FIG. 2, where three electrical operating units 3 are connected to the power supply wires 4 and positioned between the central control unit 2 and the end module 5. Between periods with operation of the electrical operating units 3, the central control unit 2 provides a test voltage to the end module 5 via the power supply wires 4. The test voltage is insufficient to operate the electrical operating units 3, i.e. due to the impedance of the electrical operating units 3 the test voltage may for instance not result in an adjustment of a movable member. The characteristic predetermined load impedance pattern caused by the end module 5 in response to the supplied test voltage is detected by the central control unit 2.

FIG. 3 shows a part of a voltage/current graph 21 for an electrical operating unit according to an embodiment of the invention. The electric operating unit typically has an impedance that varies with the provided voltage, as mentioned above. This may be at least partly due to an electric control circuit. The impedance is typically high for low voltage and decreases for higher voltages as shown. R1 illustrates the impedance of an electric operating unit at a particular test voltage V_T. The voltage/current characteristic at the operating voltage of the electrical operating unit is not shown.

FIG. 4 illustrates in more detail the principle of supplying a test voltage U to the end module 5 and detecting the resulting characteristic predetermined load impedance pattern, more specifically a simple embodiment is shown where the characteristic predetermined load impedance pattern is detected by measuring a voltage variation. When the test voltage U is provided to the end module 5, electric control circuitry 16 of the end module 5 may for instance periodically cause a switchable electrical component 12 to switch the state of end module 5 between a high impedance state and a low impedance state. The switchable electrical component 12 may be a switch or a controlled current source. The electric control circuitry 16 may comprise a microprocessor generating a control signal 17 for controlling the switchable electrical component 12. The electric control circuitry 16 may additionally comprise circuitry for protecting the microprocessor from overloading when the operating voltage is applied. When the end module 5 is in the low impedance state, the switchable electrical component 12 may provide a circuit path 22 circumventing the electrical operating unit 3, where the circuit path has a low impedance relative to the impedance R1 of the electrical operating unit 3 at the test voltage U e.g. an impedance close to zero. Consequently, the overall impedance of the building ventilation system 1 will become low when the end module 5 is in the low impedance state. When the end module 5 is in the high impedance state, the switchable electrical component 12 may break the electrical circuit path 22. Consequently, the overall impedance of the building ventilation system 1 will increase. In the illustrated example, the overall impedance of the building ventilation system 1 will increase to approximately the impedance R1 of electrical operating unit 3 at the test voltage U, when the electrical circuit path 22 is broken.

The end module 5 may further comprise a capacitor 15 for providing power to the electric control circuitry 16, when the end module 5 is in the low impedance state. The capacitor 15 is preferably connected to one of the power supply wires 4 through a diode 14 for preventing the capacitor 15 from discharging through the switchable electrical component 12, when the end module 5 is in the low impedance state.

The resistor R2 in the central control unit 2 may be used to scale the test voltage U and limit the overall power usage under test condition.

The predetermined switching is illustrated by the square waveform 13 detected at the central control unit 2. In case there is a break along the power supply wires 4, the characteristic predetermined load impedance pattern, detected in this exemplary embodiment as a voltage variation, cannot be detected by the central control unit 2 and thereby an indication of a wire break is provided. The detection of characteristic predetermined load impedance pattern is preferably implemented by measuring a voltage variation, because it allows for a very cheap and simple implementation compared to measuring a current variation.

FIG. 5 shows a schematic diagram of an electric operating unit according to an embodiment of the present invention. The electric operating unit 3 comprises a control circuit 18 connected to a motor 19. The control circuit 18 is connected to a central unit (not shown) through two power supply wires. The control circuit 18 may further optionally be connected to the central unit through a communication wire. The control circuit 18 may comprise an electronic stop for protecting the motor 19. Returning to FIG. 1, the central control unit 2 is connected to control points 7 associated with electrical operating units 3 of different building areas 6. Hence the control points 7 may be associated with electrical operating units located in for instance two neighbouring building areas. Alternatively, each of the control points 7 is associated with electrical operating units of only one building area. Evidently, several control points 7 may be associated with the same building area. The control points 7 may be connected to the system controller 2 via a common serial bus comprising a power supply and communication line 8 between the system controller 2 and the control points 7. Hence the physical connection of the control points 7 to the central control unit cannot be used to determine which building area a control point should be associated with. Therefore, the association of the control points 7 to the building areas is programmed in the central control unit during installation or reconfiguration of a smoke ventilation system according to the invention. The control points 7 are powered by the central control unit 2 via two power supply wires. The serial communication between the system controller 2 and the control points 7 are preferably deployed by using a LIN bus and logic addresses in order to reduce the power consumption for communication over long distances.

The control points 7 comprise a manual detection means 9 such as a push button, which may be use to activate the control points 7 if a fire or smoke is detected. The control points 7 may also comprise automatic smoke detection means 10 such as a fire or smoke detector, which also may activate the control points 7. When one or more control points 7 are activated a control signal is communicated in series to the central control unit 2 via the communication wire. The control signal enables the central control unit 2 to activate operation of the electrical operating units 3 of the building area associated with the activated control point(s) 7 when smoke or fire is detected.

In order to enable comfort ventilation the control points 7 may further comprise manual operation means 9, which may be used to open and close the windows of a building area by communicating a control signal to the central control unit 2, which, however, does not indicate to the system controller 2 that smoke or fire has been detected.

Moreover, the control points 7 may be used to indicate the status of the associated electrical operating units 3. As mentioned above the central control unit 2 may gather information about the present status of a connection to an electrical operating unit or a group of electrical operating units 3. This information such as a status signal pertaining to the operation of the electrical operating units 3 indicating a failure in operation or a cable break may be communicated via the system controller 2 to the associated control points 7 so that a failure in the smoke ventilation system may be indicated by e.g. a flashing red light or a sound indicator. Likewise, a status signal may be used at the control points 7 to indicate that the operation of the associated electrical operating units 3 is as desired, e.g. by use of a green light. This two-way communication between the electrical operating units 3 and the control points 7 via the central control unit 2 may then be used to discover a failure in the operation of the smoke ventilation system 1.

The central control unit comprises a power supply module connected to the power supply grid and powering the electrical operating units 3 and the control points 7. A programming and communication module is powered by the power supply module. The programming and communication module handle communication between the control points 7 and the associated electrical operating units 3. The configuration of the smoke ventilation system and the association of the control points 7 to different window actuators 3 may be performed by using a display and an input device of the programming and communication module or a port for connecting a computer to the programming and communication module.

The invention claimed is:

1. A building ventilation system comprising a central control unit and at least one electrical operating unit for adjusting a movable member of a ventilation device, the central control unit is connected to the at least one electrical operating unit by two power supply wires and configured to provide an operating voltage for operation of the at least one electrical operating unit via the two power supply wires, wherein the two power supply wires are connected to an end module and the central control unit further is configured to provide a test voltage via the power supply wires being lower than the operating voltage, wherein the end module is configured to temporarily vary its load impedance with a predetermined pattern, and wherein the end module is configured to temporarily vary its load impedance by being switchable between a low impedance state and a high impedance state, wherein the end module provides an alternative circuit path circumventing the at least one electrical operating unit when the end module is in the low impedance state, when the test voltage is provided, the end module is in high impedance state, and the central control unit is configured to detect the temporarily varying load impedance of the end module.

2. A building ventilation system according to claim 1, wherein the impedance of the end module is lower than the impedance of the at least one electrical operating unit, when the end module is in the low impedance state.

3. A building ventilation system according to claim 1, wherein the impedance of the end module is higher than the impedance of the at least one electrical operating unit, when the end module is in the high impedance state.

4. A building ventilation system according to claim 1, wherein the end module is in the low impedance state at least 20% of the time when the test voltage is provided.

5. A building ventilation system according to claim 1, wherein the test voltage is less than 50% of the operating voltage.

6. A building ventilation system according to claim 1, wherein the temporarily varying load impedance of the end module is detected in the central control unit by measuring a voltage variation.

7. A building ventilation system according to claim 1, wherein the end module is connected to the central control unit by no more than the two power supply wires.

8. A building ventilation system according to claim 1, wherein the test voltage is less than 25% of the operating voltage.

9. A building ventilation system according to claim 1, wherein the test voltage is about 15% of the operating voltage.

10. A building ventilation system according to claim 1, wherein the end module is in the low impedance state at least 30% of the time when the test voltage is provided.

11. A building ventilation system according to claim 1, wherein the end module is in the low impedance state at least 50% of the time when the test voltage is provided.

12. A building ventilation system according to claim 1, wherein the two power supply lines connect the end module to the central control unit in parallel with the at least one electrical operating unit.

* * * * *